US009362698B2

(12) United States Patent
Lau et al.

(10) Patent No.: US 9,362,698 B2
(45) Date of Patent: Jun. 7, 2016

(54) BRUSH MOTOR COMMUTATOR WITH SPARK SUPPRESSION AND METHOD FOR MAKING THE SAME

(71) Applicant: Johnson Electrics S.A., Murten (CH)

(72) Inventors: James Ching Sik Lau, Hong Kong (CN); Wilfried Gorlt, Filderstadt (DE)

(73) Assignee: JOHNSON ELECTRICS S.A., Murten (CH)

( * ) Notice: Subject to any disclaimer, the term of this patent is extended or adjusted under 35 U.S.C. 154(b) by 349 days.

(21) Appl. No.: 14/024,996

(22) Filed: Sep. 12, 2013

(65) Prior Publication Data

US 2014/0070660 A1 Mar. 13, 2014

(30) Foreign Application Priority Data

Sep. 12, 2012 (CN) ..... 2012 1 0336520
Sep. 12, 2012 (CN) ..... 2012 1 0336532

(51) Int. Cl.

| | |
|---|---|
| ***H01R 39/04*** | (2006.01) |
| ***H01R 39/46*** | (2006.01) |
| ***H01R 39/02*** | (2006.01) |
| ***H01R 43/06*** | (2006.01) |
| ***H01R 39/48*** | (2006.01) |

(52) U.S. Cl.

CPC ..... *H01R 39/46* (2013.01); *H01R 39/027* (2013.01); *H01R 39/48* (2013.01); *H01R 43/06* (2013.01); *Y10T 29/49011* (2015.01)

(58) Field of Classification Search

CPC ..... H01R 39/04; H01R 39/46; H01R 39/48; H01R 43/06; H01R 39/027

USPC ..... 310/233, 234, 235; 29/596, 597

See application file for complete search history.

(56) References Cited

U.S. PATENT DOCUMENTS

| | | | | |
|---|---|---|---|---|
| 8,242,659 | B2 * | 8/2012 | Maeda | H02K 13/105 310/222 |
| 2003/0080647 | A1 * | 5/2003 | Tanaka | H01R 43/14 310/233 |
| 2007/0114876 | A1 * | 5/2007 | Kumar | H01R 39/54 310/220 |

FOREIGN PATENT DOCUMENTS

| | | |
|---|---|---|
| GB | 1360358 | 7/1974 |
| JP | 56-058756 | 5/1981 |
| JP | 2004328896 A | 11/2004 |

* cited by examiner

*Primary Examiner* — Hanh Nguyen

(74) *Attorney, Agent, or Firm* — Muncy, Geissler, Olds & Lowe, P.C.

(57) ABSTRACT

A commutator (10, 40, 54, 60, 64, 70, 76, 78) for a brush motor includes a cylindrical insulating base (12), a plurality of segments (14) disposed on an outer surface (68) of the insulating base (12), circumferentially spaced from each other, and defining a plurality slots (42) between adjacent segments (14), and a plurality of insulating outgas elements (24) capable of releasing a gas having a lower conductivity than air and disposed on the outer surface (68) of the cylindrical insulating base (12). Each outgas element (24) is located between a corresponding pair of the plurality of segments (14), having a gas releasing surface (26) between the corresponding pair of segments (14) and lower than outer surfaces (28) of the corresponding pair of segments (14). A method for making a commutator is also provided.

21 Claims, 9 Drawing Sheets

BRUSH MOTOR COMMUTATOR WITH SPARK SUPPRESSION AND METHOD FOR MAKING THE SAME

CROSS REFERENCE TO RELATED APPLICATIONS

This non-provisional patent application claims priorities under 35 U.S.C. §119(a) from Patent Application No. 201210336520.0 filed in The People's Republic of China on 12 Sep. 2012 and Patent Application No. 201210336532.3 filed in The People's Republic of China on 12 Sep. 2012.

FIELD OF THE INVENTION

This invention relates to a commutator for brush motors and in particular, to a spark suppressing arrangement for the commutator.

BACKGROUND OF INVENTION

A brush motor typically includes a stator and a rotor. The rotor includes a shaft, a rotor core fixed on the shaft, a commutator fixed on the shaft adjacent the rotor core, and rotor windings wound about the teeth of the rotor core and electrically connected to the commutator. The stator includes stator magnetic poles, power terminals and at least a pair of brushes in sliding contact with segments of the commutator. External power is supplied to the rotor windings via the power terminals, the brushes and the commutator. When electrified, the rotor windings form rotor magnetic field which interacts with stator magnetic field to drive the rotor to rotate.

During commutation, when a brush leaves a segment of the commutator, the current passing through the corresponding rotor winding changes abruptly, thereby generating a large induced electromotive force and a strong electric field across an air gap between the brush and the segment. The air around the brush and the segment may be ionized under the strong electric field to form a discharge path and generate sparks. The spark may damage the slide contact between the brush and the commutator, which increases the worn of the brush and the commutator. Hence there is a desire for a commutator with diminished spark.

SUMMARY OF THE INVENTION

Accordingly, in one aspect thereof, the present invention provides a commutator for a brush motor includes a cylindrical insulating base, a plurality of segments disposed on an outer surface of the insulating base, circumferentially spaced from each other, and defining a plurality slots between adjacent segments, and a plurality of insulating outgas elements capable of releasing a gas having a lower conductivity than air and disposed on the outer surface of the cylindrical insulating base. Each outgas element is located between a corresponding pair of the plurality of segments, having a gas releasing surface between the corresponding pair of segments and lower than outer surfaces of the corresponding pair of segments.

Preferably, said plurality of outgas elements at least partly extend into the plurality of slots between adjacent segments.

Preferably, at least one of two opposite side surfaces of a pair of adjacent segments has a recess, and an outgas element of said plurality of outgas elements extends into the recess.

Preferably, the gas release surface of one of said plurality of outgas elements has a side surface defining a circumferential gap with one of two opposite side surfaces of a corresponding pair of adjacent segments.

Preferably, one of said plurality of outgas elements extends into a groove in the outer surface of said cylindrical insulating base and is radially confined by inner surfaces of a corresponding pair of adjacent segments.

Preferably, the gas releasing surface of one of said plurality of outgas elements is lower than or aligned with inner surfaces of a corresponding pair of adjacent segments.

Preferably, the gas releasing surface of one of said plurality of outgas elements includes an uneven surface.

Preferably, two opposite side surfaces of a pair of adjacent segments are inclined relative to a radial direction of said cylindrical insulating base, and a distance between the two opposite side surfaces gradually increases along the radial direction.

Preferably, said plurality of outgas elements and said cylindrical insulating base are formed as a monolithic member.

Preferably, said plurality of outgas elements and said cylindrical insulating base are detachably assembled together.

Preferably, said plurality of outgas elements are made of a same material as said cylindrical insulating base.

Preferably, said plurality of outgas elements and said cylindrical insulating base are made of different materials.

Preferably, said plurality of outgas elements are made of a thermal plastic material capable of spontaneously releasing a gas having a conductivity lower than air.

Preferably, said plurality of outgas elements are made of Polyamide 66.

Preferably, said cylindrical insulating base is made of a thermosetting material.

According to a second aspect, the present invention provides a method for making a commutator, comprising identifying an insulating base, disposing a plurality of segments circumferentially spaced on an outer surface of the insulating base, and disposing a plurality of insulating outgas elements capable of releasing a gas having a conductivity lower than that of air and spaced on the outer surface of the insulating base between corresponding pairs of adjacent segments with gas releasing surfaces lower than outer surfaces of the segments.

Preferably, disposing a plurality of insulating outgas elements further includes disposing an outgas element of the plurality of outgas elements at least partially in a slot between a corresponding pair of adjacent segments.

Preferably, disposing a plurality of segments includes disposing a plurality of segments at circumferential intervals, disposing a plurality of insulating outgas elements includes disposing an outgas element of the plurality of outgas elements at least partially in a slot between a corresponding pair of adjacent segments, and identifying an insulating base includes disposing an insulating base on the outgas elements and inner surfaces of the segments.

Preferably, identifying an insulating base further includes forming a plurality of grooves on the outer surface of the insulating base, disposing a plurality of segments further includes placing two adjacent segments on opposite sides of a groove of the plurality of grooves on the outer surface of the insulating base, and disposing a plurality of insulating outgas elements further includes disposing an outgas element of the plurality of outgas elements at least partially in a corresponding groove on the outer surface of the insulating base.

Preferably, disposing a plurality of segments includes providing a metal ring, identifying an insulating base includes disposing an insulating base on an inner surface of the metal ring, the insulating base having a plurality of grooves or holes on an outer periphery thereof, disposing a plurality of insulating outgas elements includes disposing the plurality outgas elements in the plurality of grooves or holes, and disposing a plurality of segments further includes forming a plurality of through slots in the metal ring to form the segments and expose the outgas elements.

Preferably, disposing a plurality of segments includes providing a metal ring, disposing a plurality of insulating outgas elements includes disposing the plurality outgas elements on an inner surface of the metal ring, identifying an insulating base includes disposing an insulating base on the outgas elements and an inner surface of the metal ring, and disposing a plurality of segments further includes forming a plurality of through slots in the metal ring to form the segments and expose the outgas elements.

BRIEF DESCRIPTION OF THE DRAWINGS

Various embodiments of the invention are described, by way of example only, with reference to the drawings, in which identical or related structures, elements, or parts may be labeled with the same reference numerals throughout the figures. Dimensions of components and features shown in the figures are generally chosen for convenience and clarity of presentation and are not necessarily shown to scale.

DETAILED DESCRIPTION OF THE PREFERRED EMBODIMENTS

Figure 1:
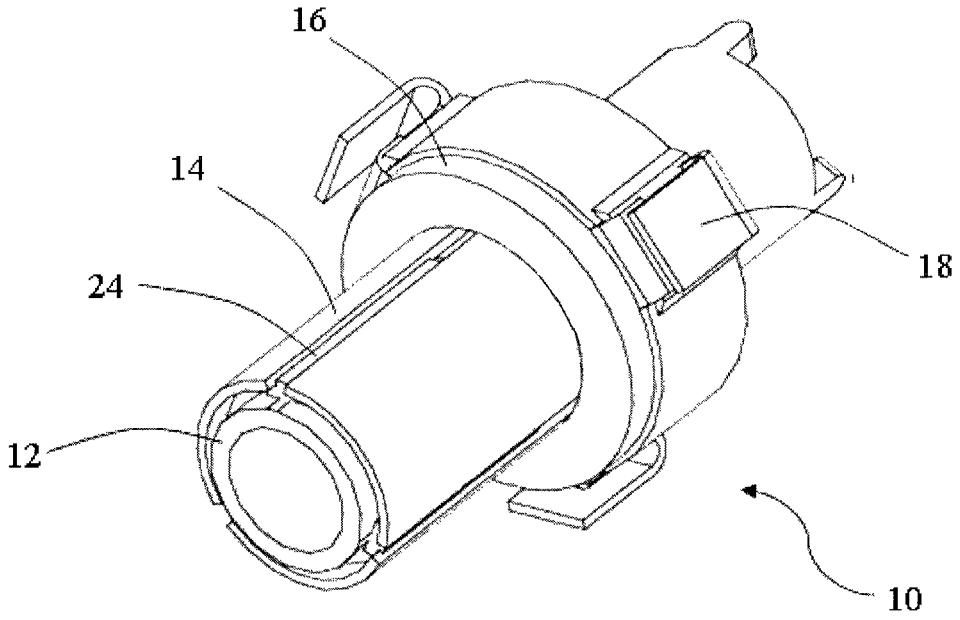
FIG. 1 illustrates a commutator for a brush motor in accordance with an embodiment of the present invention.
Figure 2:
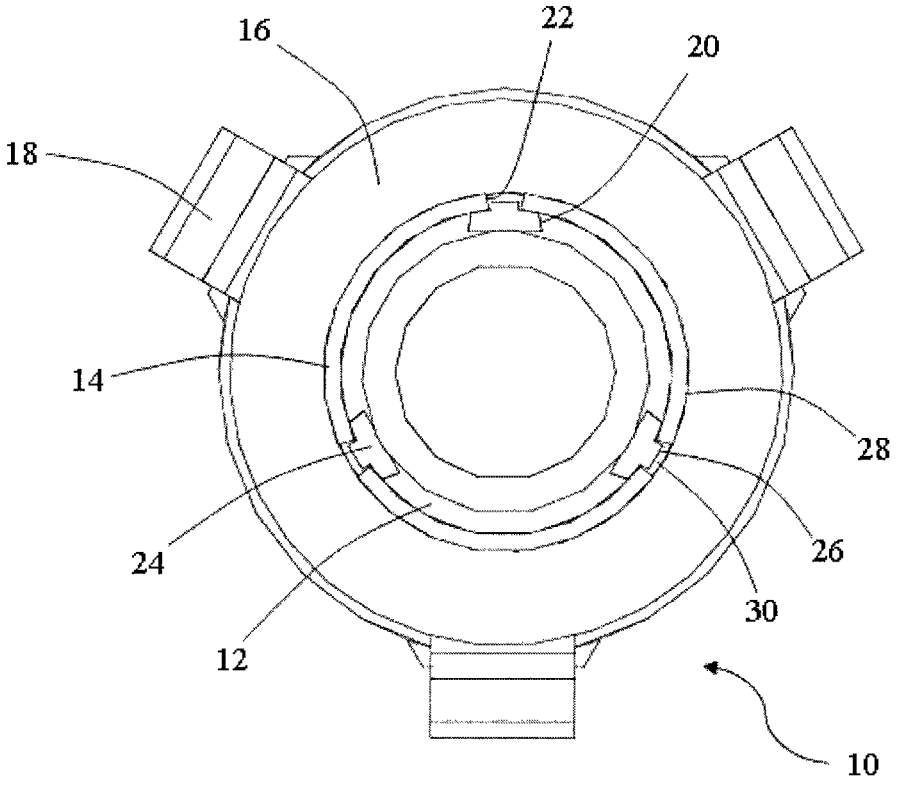
FIG. 2 illustrates a planar view of the commutator shown in FIG. 1.
Figure 3:
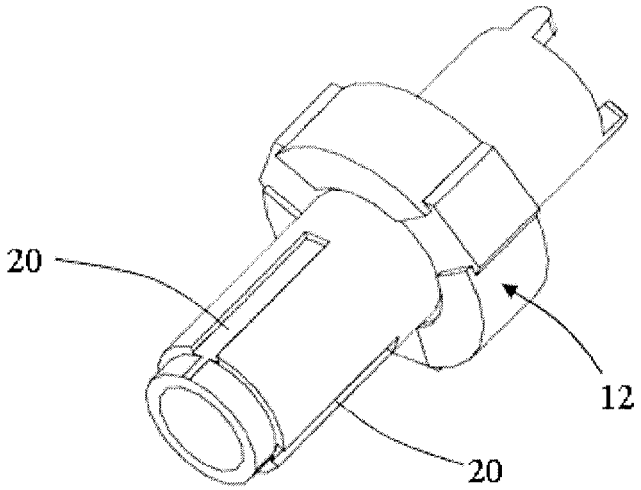
FIG. 3 illustrates an insulating base of the commutator shown in FIG. 1.
Figure 4:
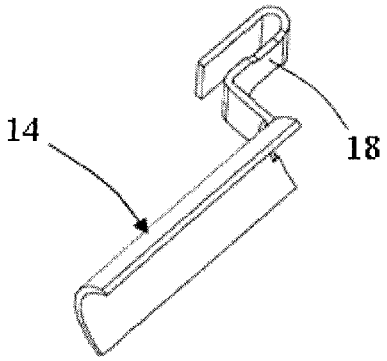
FIG. 4 illustrates a segment of the commutator shown in FIG. 1.
Figure 5:
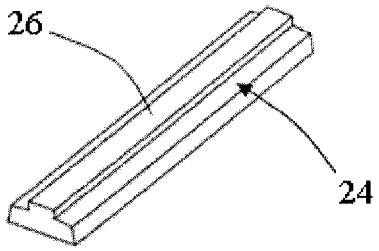
FIG. 5 illustrates an outgas element on the commutator shown in FIG. 1 in accordance with an embodiment of the present invention.

FIG. 1 illustrates a commutator 10 for a brush motor in accordance with an embodiment of the present invention. FIG. 2 illustrates a planar view of the commutator 10. FIGS. 3, 4, and 5 illustrate an insulating base 12, a segment 14 and an outgas element 24, respectively, of the commutator 10. The commutator 10 includes a hollow insulating base 12 and a plurality of segments 14 disposed on the outer surface of the insulating base 12. A ring 16 is tightly sleeved on the outer surfaces of the segments 14 for radially positioning the segments 14. Every segment 14 has a terminal 18 at one end thereof for electrically connecting with a rotor winding 36 (shown in FIG. 6) of the motor.

In accordance with an embodiment of the present invention, a plurality of axially extending grooves 20 are formed in the outer surface of the insulating base 12 at regular intervals in the circumferential direction. The segments 14 are arranged between adjacent grooves 20. The circumferential distance between two opposite side surfaces 22 of two adjacent segments 14 is smaller than the circumferential width of the groove 20 so that the opposite side surfaces 22 of the adjacent segments 14 and the corresponding groove 20 define an inverted T-shaped slot. An inverted T-shaped insulating outgas element 24 is disposed in the inverted T-shaped slot.

Preferably, the outgas elements 24 and the insulating base 12 are made of different materials. In accordance with a preferred embodiment, the outgas elements 24 are made of a thermal plastic material such as, for example, Polyamide 66 that is sometimes also referred to as PA66, which is able to spontaneously release a gas with conductivity lower than air. The portion of the outer surface of an outgas element 24 between two corresponding adjacent segments 14 forms a gas releasing surface 26. The gas releasing surface 26 is radially lower than the outer surfaces 28 of the segments 14, so that the gas releasing surface 26 and the opposite side surfaces 22 of two adjacent segments 14 define a space 30 through which the gas released from the outgas element 24 spreads. The inverted T-shaped configuration makes the outgas elements 24 radially confined and prevents the outgas elements 24 from being thrown out during the high speed rotation of the commutator 10. It also increases the size of the outgas elements 24, thereby prolonging the usable life of the outgas elements 24 and/or increasing the gas released from the outgas elements 24.

Figure 6:
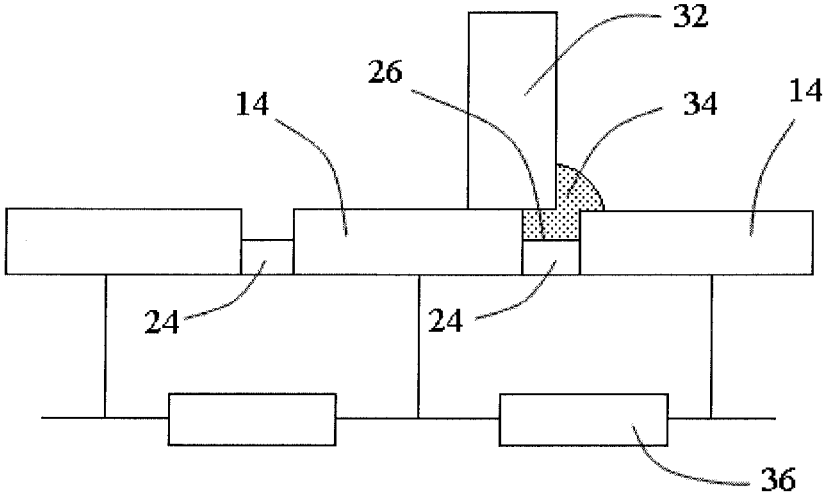
FIG. 6 illustrates a spark suppression process in accordance with an embodiment of the present invention.

FIG. 6 illustrates a spark suppression process of the commutator 10. During the operation of the motor, the outgas elements 24 in the commutator 10 spontaneously release gas 34 with conductivity lower than air via the gas releasing surface 26. The gas 34 spreads between the adjacent segments 14 and between the commutator segments 14 and the brush 32 of the motor. When the rotor windings 36 of the motor generates large inductive electromotive force during commutation, the gas 34, with its low conductivity, would reduce or diminish gas ionization (also referred to as arc discharge) generated between two adjacent segments 14 and between the segment 14 and the brush 32. In other words, the electric arc in the air decreases, which reduces the brush 32 and the segments 14 from being worn. By configuring the gas releasing surface 26 to be radially lower than the outer surfaces of the segments 14, friction between the outgas element 24 and the brush 32 is avoided, and no outgas element powder or solid particle is generated and attached to the outer surfaces 28 of the segments 14 to negatively influence the conductivity between the segments 14 and the brush 32.

The commutator 10 may be formed by following an exemplified method described infra. The segments 14, the ring 16, the outgas elements 24 and the insulating base 12 with the grooves 20 are separately fabricated firstly. The outgas elements 24 are then inserted into the grooves 20 in the outer surface of the insulating base 12. After that, the segments 14 are assembled on the outer surface of the insulating base 12 and between adjacent outgas elements 24, and the ring 16 is sleeved on the outer surfaces of the segments 14 to radially confine the segments 14 on base 12.

According to another exemplified method, the outgas elements 24 are inserted into the inverted T-shaped slots defined by the opposite side surfaces 22 of two adjacent segments 14 and corresponding groove 20 in the base 12 after the segments 14 are assembled on the outer surface of the insulating base 12.

In the above described exemplified methods, the outgas elements 24 are independently formed and inserted into corresponding grooves 20 in the base 12 so that the outgas elements 24 and the insulating base 12 form pieces detachable from each other. According to another exemplified method, the outgas elements 24 are injection-molded in the grooves 20 in the insulating base 12, before or after assembling the segments 14 to the insulating base 12, so that the outgas elements 24 and the insulating base 12 form an inseparable or undetachable single piece.

Figure 7:
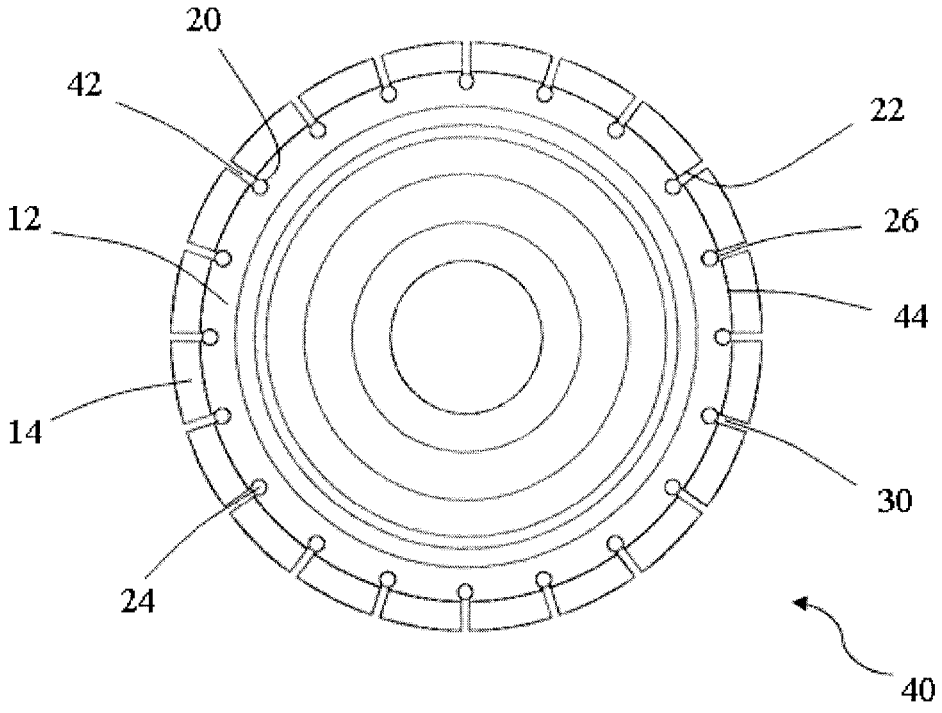
FIG. 7 illustrates a planar view of a commutator in accordance with another embodiment of the present invention.

FIG. 7 illustrates a commutator 40 in accordance with another embodiment of the present invention. The commutator 40 includes a hollow insulating base 12 and a plurality of segments 14 disposed on the outer surface of the insulating base 12 with a through slot 42 between adjacent segments 14. A plurality of axially extending grooves 20 are formed in the outer surface of the insulating base 12 at regular intervals in the circumferential direction. Every groove 20 is connected with a corresponding through slot 42. The outgas element 24 is entirely disposed in the groove 20. The portion of the outer surface of the outgas element 24 between two adjacent segments 14 forms a gas releasing surface 26 that is radially lower than the inner surfaces 44 of the segments 14. The gas releasing surface 26 and two opposite side surfaces 22 of two adjacent segments 14 define a space 30 through which the gas released from the outgas element 24 spreads.

Figure 8:
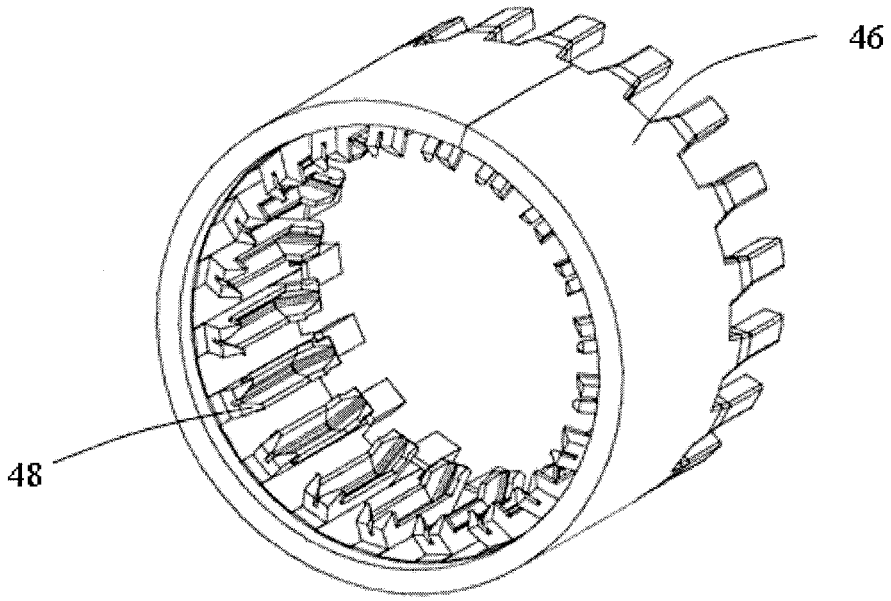
FIGS. 8 to 10 illustrate an exemplified method of forming the commutator shown in FIG. 7.
Figure 9:
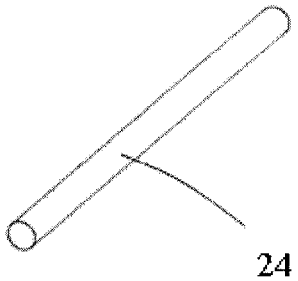
Figure 10:
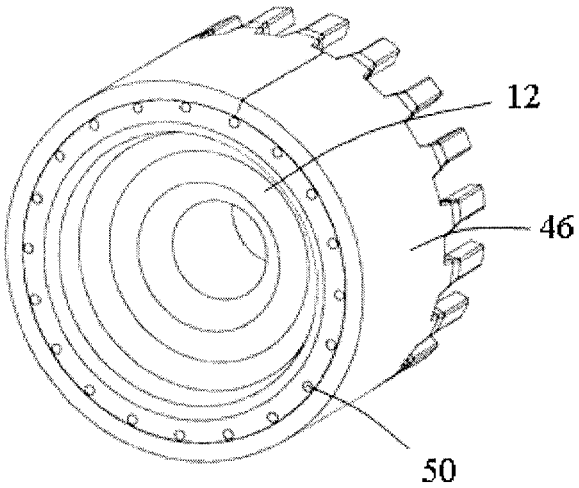

FIGS. 8 to 10 illustrate an exemplified method of forming the commutator 40. Firstly, a metal ring 46 (shown in FIG. 8) and a plurality of outgas elements 24 (shown in FIG. 9) are separately fabricated. The metal ring 46 has a plurality of radial projections 48 projected from the inner surface thereof. The outgas element 24 is an elongate member with circular cross section. Secondly, as shown in FIG. 10 and in an overmolding process, the insulating base 12 is molded on the inner surface of the metal ring 46 with a plurality of holes 50 formed at the outer periphery of the insulating base 12 with the projections 48 embedded in the insulating base 12. The holes 50 may be formed by unloading the insulating base 12 from a mould having a plurality of corresponding protrusions after the insulating base 12 is molded on the inner surface of the inner surface of the metal ring 46 and the projections on the mould. The projections 48 on the inner surface of the metal ring 46 intensifies the bonding between the insulating base 12 and the metal ring 46. Alternatively, the holes 50 can be replaced by grooves in the outer surface of the insulating base 12. It should be understood the insulating base 12 may be formed on the inner surface of the metal ring 46 by other known ways to form an inseparable or undetachable single piece with the metal ring 46. Then, the outgas elements 24 are inserted into the holes 50 or the grooves in the insulating base 12. Finally, through slots 42 are formed in the metal ring 46 to form segments 14 and expose the outgas elements 24. Preferably, the through slots 42 are formed by cutting.

In the above described method, the through slots 42 are formed after the outgas elements 24 are inserted into the holes 50 or the grooves in the insulating base 12. According to another exemplified method, the through slots 42 are formed to connect with the holes 50 or the grooves in the insulating base 12 before the outgas elements 24 are inserted into the holes 50 or the grooves.

In above described methods, the outgas elements 24 are independently formed and then inserted into corresponding holes 50 or grooves so that the outgas elements 24 and the insulating base 12 are detachable from each other. Alternatively, the outgas elements 24 are injection-molded in the holes 50 or the grooves in the insulating base 12 so that the outgas elements 24 and the insulating base 12 form an inseparable or undetachable single piece.

Figure 11:
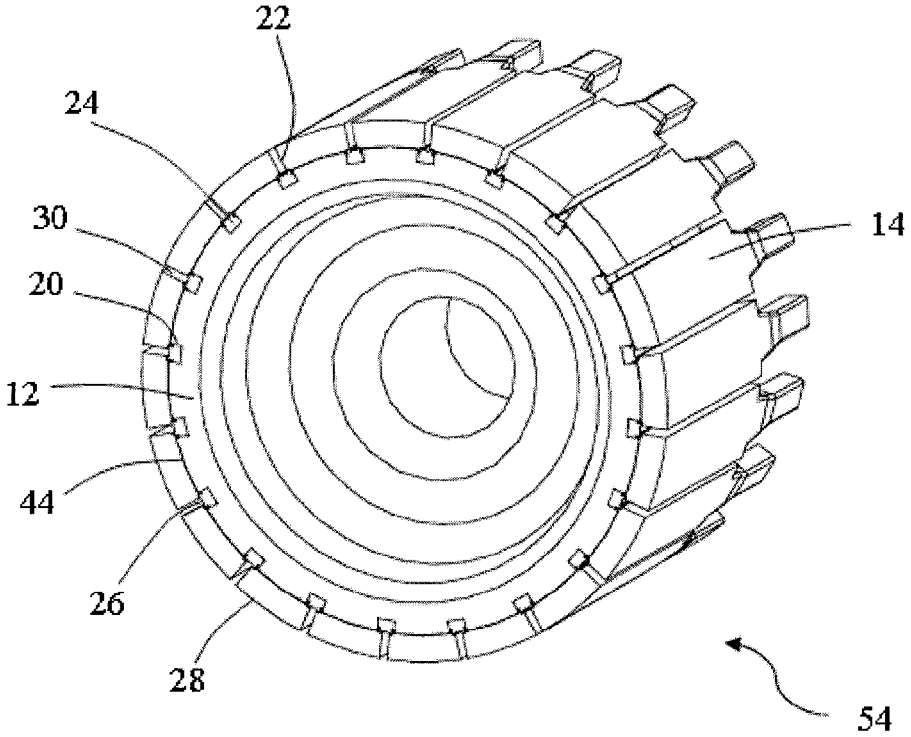
FIG. 11 illustrates a planar view of a commutator in accordance with yet another embodiment of the present invention.
Figure 12:
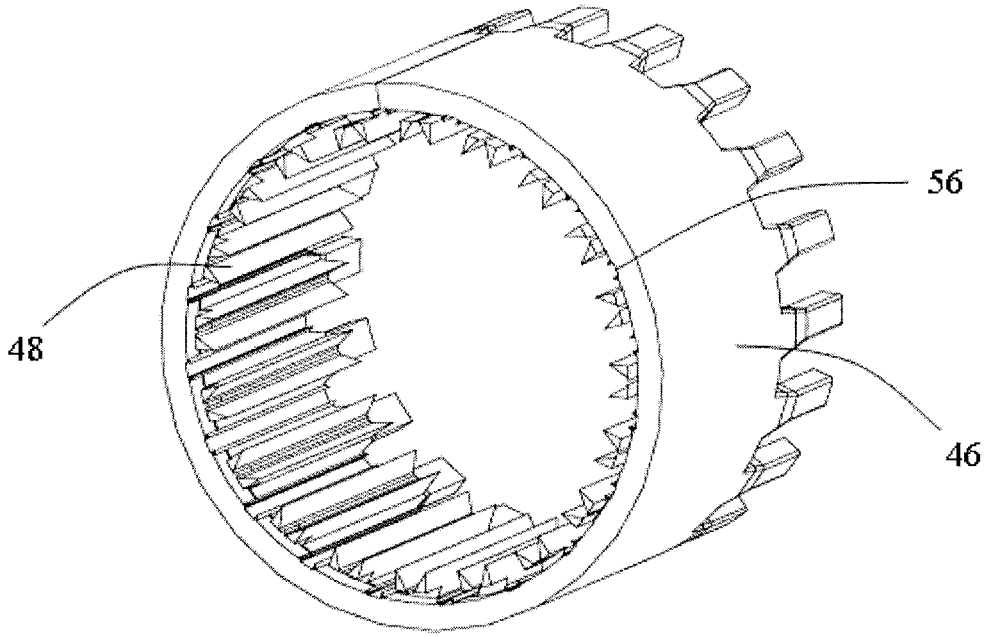
FIGS. 12 to 15 illustrates an exemplified method of forming the commutator shown in FIG. 11.

FIG. 11 illustrates a commutator 54 in accordance with yet another embodiment of the present invention. In this embodiment, the insulating base 12 of the commutator 54 is disposed on the outgas elements 24 and the inner side of the segments 14. The opposite side surfaces 22 of two adjacent segments 14 and a corresponding groove 20 in the outer surface of the insulating base 12 define an inverted T-shaped slot. The outgas elements 24 are entirely disposed in the grooves 20. The gas releasing surface 26 of the outgas element 24 between two adjacent segments 14 is radially higher than the inner surface but lower than the outer surfaces 28 of the segments 14. The gas releasing surface 26 and the opposite side surfaces 22 of two adjacent segments 14 define a space 30 through which the gas released from the outgas element 24 spreads.

Figure 13:
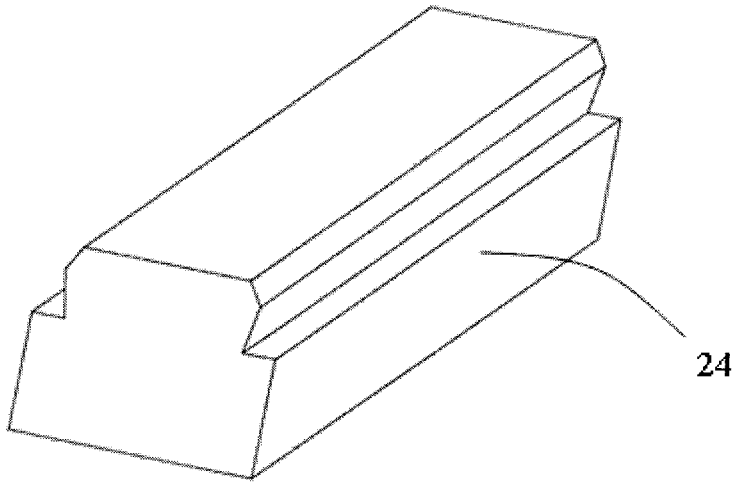
Figure 14:
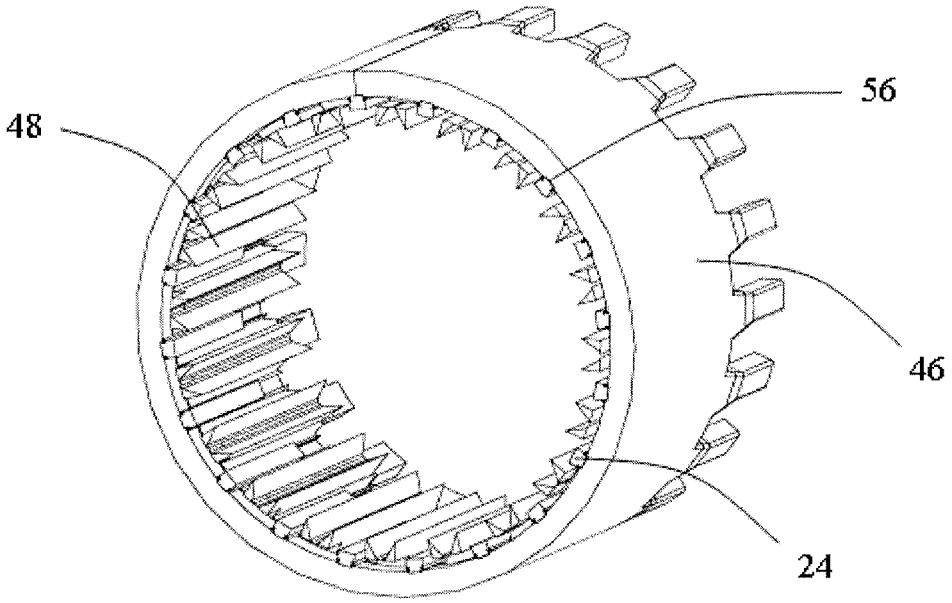
Figure 15:
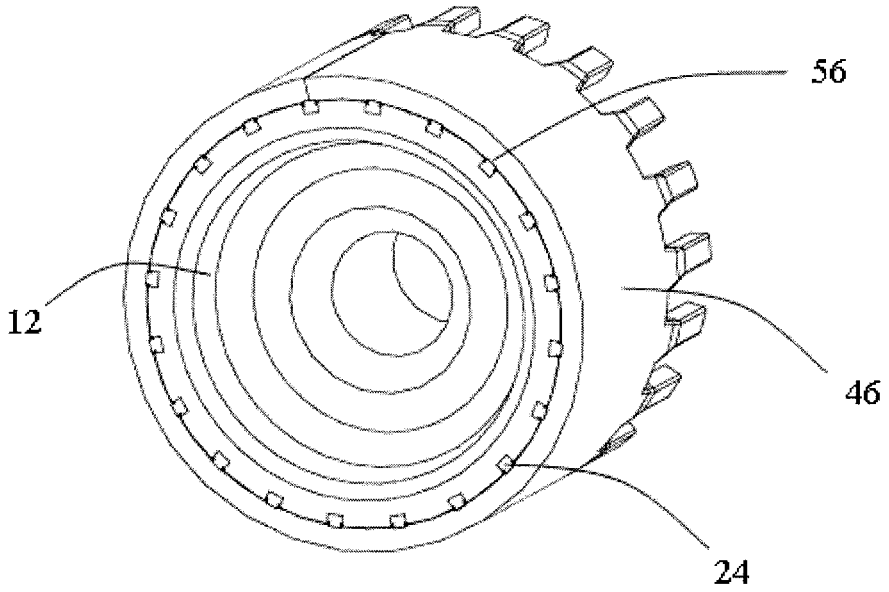

FIGS. 12 to 15 illustrate an exemplified method of forming the commutator 54. Firstly, a metal ring 46 (shown in FIG. 12) and a plurality of outgas elements 24 (shown in FIG. 13) are separately fabricated. A plurality of position slots 56 and projections 48 are alternately formed on the inner surface of the metal ring 46. The outgas element 24 is an elongate member with inverted T-shaped cross section as shown in FIG. 13. Secondly, as shown in FIG. 14, the narrow portions of the invented T-shaped outgas elements 24 are inserted into the position slots 56 in the metal ring 46. Thirdly, the insulating base 12 is molded on the outgas elements 24 and the inner side of the metal ring 46 with the projections 48 embedded in the insulating base 12. The projections 48 on the inner surface of the metal ring 46 intensifies the bonding between the insulating base 12 and the metal ring 46. It should be understood the insulating base 12 and the metal ring 46 may form an undetachable single piece by other known ways. Then, through slots 42 are formed in the metal ring 46 to expose the outgas elements 24. Preferably, the through slots 42 are formed by cutting.

In above described methods, the outgas elements 24 are independently formed and then inserted into the position slots 56. In another exemplified method, the outgas elements 24 are directly injection-molded in the position slots 56.

Figure 16:
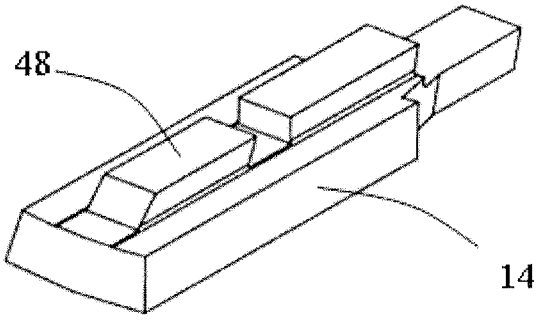
FIGS. 16 to 18 illustrate an exemplified method of forming a commutator in accordance with another embodiment of the present invention.
Figure 17:
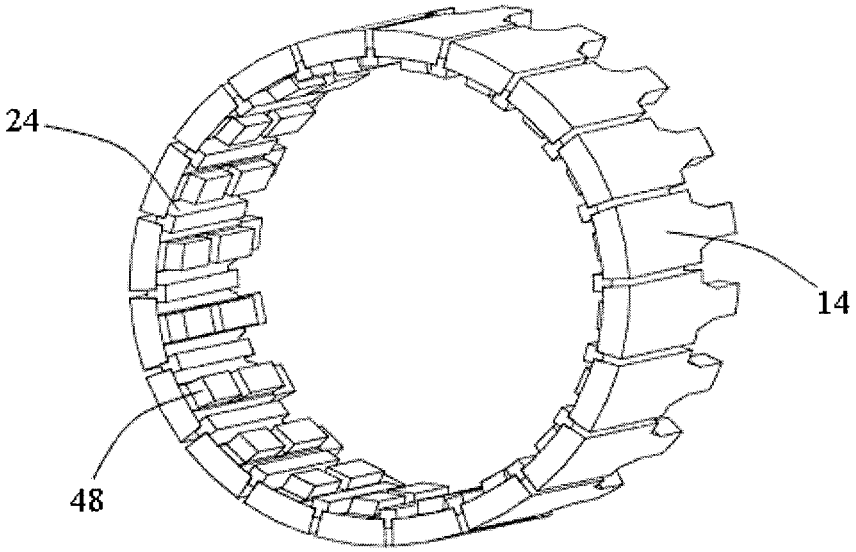
Figure 18:
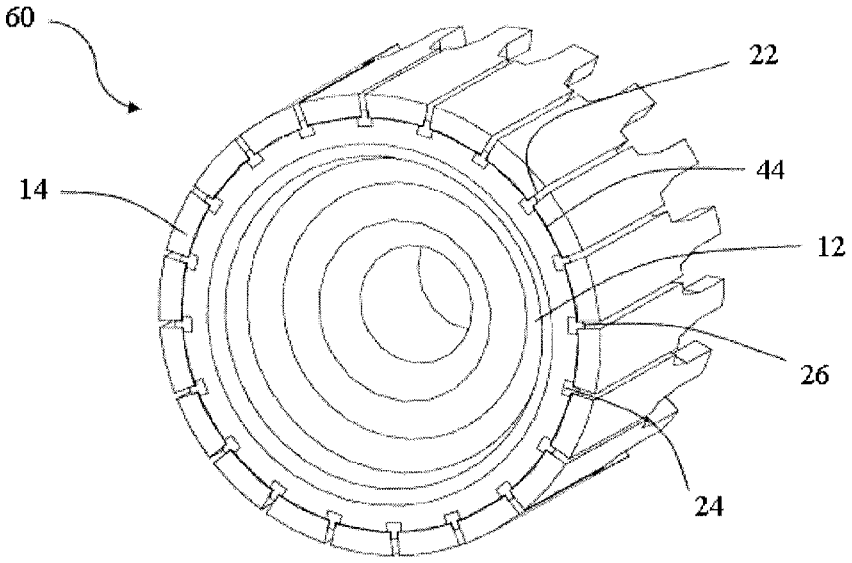

FIGS. 16 to 18 illustrate an exemplified method forming the commutator 60. Firstly, a plurality of segments 14 as shown in FIG. 16 and a plurality of outgas elements 24 as shown in FIG. 5 are separately formed. The segment 14 has a projection 48 projected from the inner surface thereof. The outgas element 24 is an elongate member with inverted T-shaped cross section. Secondly, as shown in FIG. 17, the narrow portions of the invented T-shaped outgas elements 24 are sandwiched between adjacent segments 14 such that the segments 14 and the outgas elements 24 are alternately arranged to form an annular ring. As shown in FIG. 18, the insulating base 12 is then molded on the outgas elements 24 and the inner side of the segments 14 with the projections 48 embedded in the insulating base 12. The projections 48 on the inner surfaces of the segment 14 intensifies the bonding between the insulating base 12 and the segments 14.

According to another embodiment of the present invention, the outgas elements 24 are connected together by a connecting ring. After the insulating base 12 is molded on the outgas elements 24 and the segments 14, the connecting ring can be kept or removed.

Figure 19:
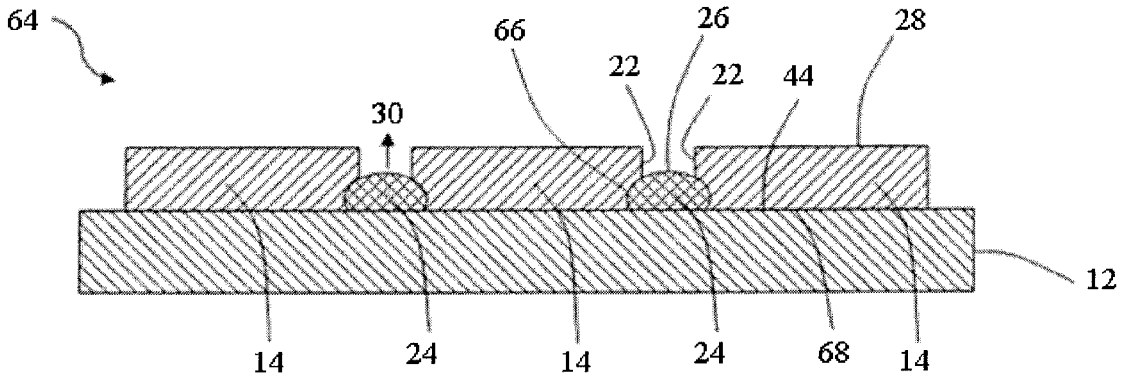
FIGS. 19 to 22 illustrate circumferential developed views of commutators in accordance with some additional embodiments of the present invention.

FIG. 19 illustrates a circumferential developed view of a commutator 64 in accordance with another embodiment of the present invention. In this embodiment, both of the opposite side surfaces 22 of two adjacent segments 14 on the outer surface 68 of the insulating base 12 have a recess 66. The outgas element 24 is arranged between the adjacent segments 14 and extends into the recesses 66 so as to be prevented from being throwing out during the high speed rotation of the commutator 64. The recesses 66 is able to receive a larger outgas element 24. According to another embodiment, only one of the opposite side surfaces 22 of two adjacent segments 14 has the recess 66.

Figure 20:
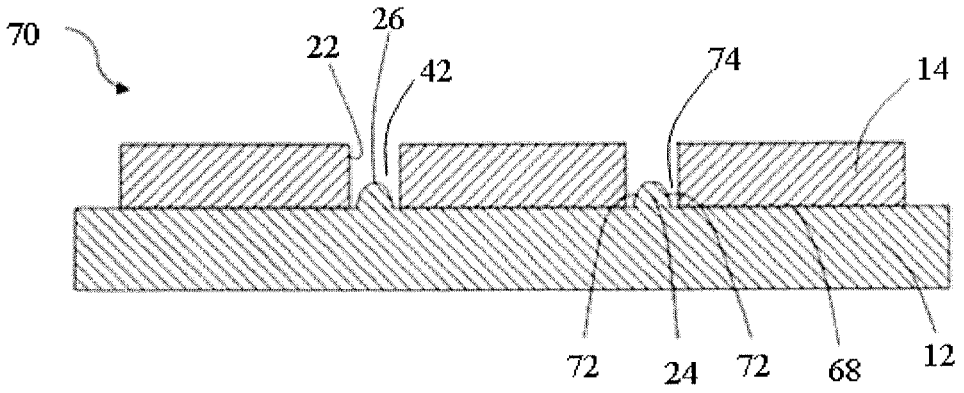

FIG. 20 illustrates a circumferential developed view of a commutator 70 in accordance with another embodiment of the present invention. The outgas elements 24 are made of the same material as the insulating base 12 and extend into the through slots 42 between the adjacent segments 14 from the outer surface of the insulating base 12. The gas releasing surface 26 of the outgas element 24 has two side surfaces 72 respectively facing two opposite side surfaces 22 of the adjacent segments 14 with a circumferential gap 74 defined between the side surface 72 of the gas releasing surface 26 and the side surface 22 of the segment 14 facing the side surface 72. By this configuration, the area of the gas releasing surface 26 increases so that the amount of gas released from the gas releasing surface 26 also increases. It should be understood the gas releasing surface 26 may have only one side surface 72 to form the circumferential gap 74 with the side surface 22 of the segment 14 facing the side surface 72. Also the gas releasing surface 26 may be an uneven surface to increase the area.

Figure 21:
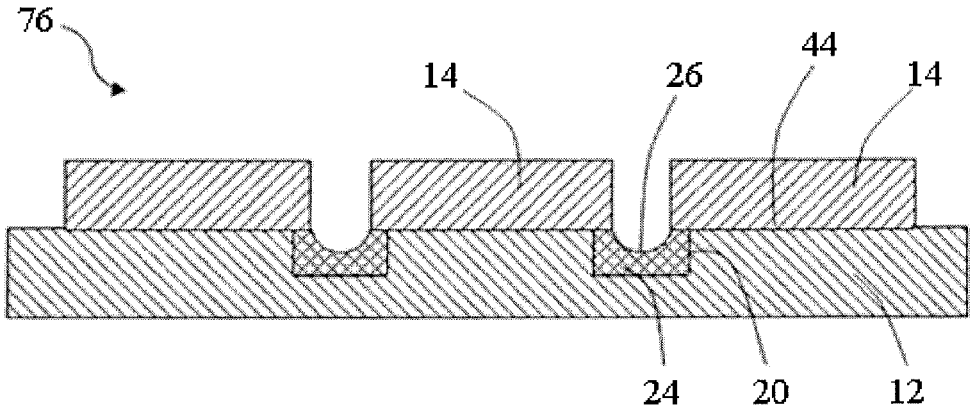
Figure 22:
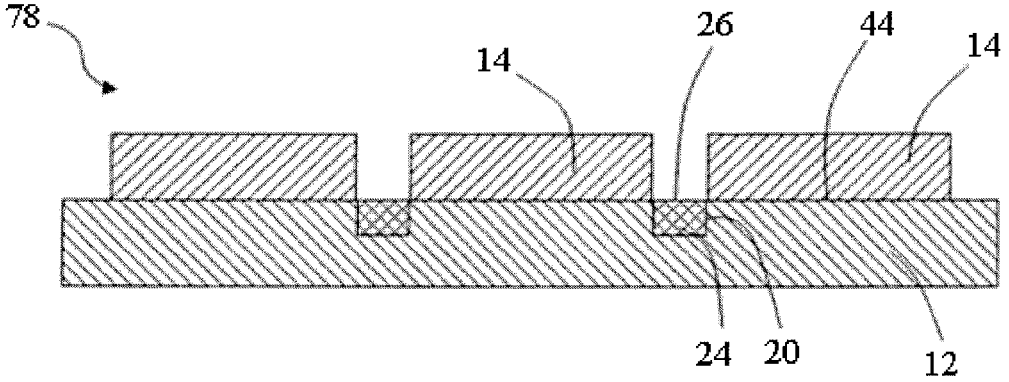

FIGS. 21 and 22 illustrate circumferential developed views of commutators 76 and 78 in accordance with two other embodiments of the present invention. In FIG. 21, the outgas element 24 of the commutator 76 is arranged in the groove 20 in the outer surface of the insulating base 12 with the gas releasing surface 26 being concaved relative to the inner surfaces 44 of the adjacent segments 14. In FIG. 22, the outgas element 24 of the commutator 78 is arranged in the groove 20 in the outer surface of the insulating base 12 with the gas releasing surface 26 and the outer surface of the insulating base 12 located on the outer surface of a same imaginary cylinder.

The commutator in accordance with embodiments of the present invention is especially suitable for high power motor applications. Under this situation, the insulating base 12 may be made of a thermosetting material to provide stable support for the segments 14 in an environment with high temperature. The outgas elements 24 are preferably made of insulating material that can spontaneously release gas with lower conductivity than air under non-high temperature condition and release more such gas under high temperature condition. It should be understood that the commutator in accordance with embodiments of the present invention is also applicable to the low power motors.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, two opposite side surfaces 22 of the adjacent segments 14 may be inclined relative to the radial direction and the distance between the two side surfaces 22 gradually increases along the direction from the inner surface 44 to the outer surface 28 of the segments 14.

For another example, the gas releasing surface 26 may be uneven so as to increase the surface area and amount of gas released.

The invention claimed is:

1. A commutator for a brush motor, comprising:

a cylindrical insulating base;

a plurality of segments disposed on an outer surface of said insulating base, circumferentially spaced from each other, and defining a plurality slots between adjacent segments; and a plurality of insulating outgas elements capable of releasing a gas having a lower conductivity than air and disposed on the outer surface of said cylindrical insulating base, each located between a corresponding pair of said plurality of segments, having a gas releasing surface between the corresponding pair of segments and lower than outer surfaces of the corresponding pair of segments.

2. The commutator according to claim 1, wherein said plurality of outgas elements at least partly extend into the plurality of slots between adjacent segments.

3. The commutator according to claim 2, wherein:

at least one of two opposite side surfaces of a pair of adjacent segments has a recess; and an outgas element of said plurality of outgas elements extends into the recess.

4. The commutator according to claim 2, wherein the gas release surface of one of said plurality of outgas elements has a side surface defining a circumferential gap with one of two opposite side surfaces of a corresponding pair of adjacent segments.

5. The commutator according to claim 1, wherein one of said plurality of outgas elements extends into a groove in the outer surface of said cylindrical insulating base and is radially confined by inner surfaces of a corresponding pair of adjacent segments.

6. The commutator according to claim 1, wherein the gas releasing surface of one of said plurality of outgas elements is lower than or aligned with inner surfaces of a corresponding pair of adjacent segments.

7. The commutator according to claim 1, wherein the gas releasing surface of one of said plurality of outgas elements includes an uneven surface.

8. The commutator according to claim 1, wherein:

two opposite side surfaces of a pair of adjacent segments are inclined relative to a radial direction of said cylindrical insulating base; and a distance between the two opposite side surfaces gradually increases along the radial direction.

9. The commutator according to claim 1, wherein said plurality of outgas elements and said cylindrical insulating base are formed as a monolithic member.

10. The commutator according to claim 1, wherein said plurality of outgas elements and said cylindrical insulating base are detachably assembled together.

11. The commutator according to claim 1, wherein said plurality of outgas elements are made of a same material as said cylindrical insulating base.

12. The commutator according to claim 1, wherein said plurality of outgas elements and said cylindrical insulating base are made of different materials.

13. The commutator according to claim 1, wherein said plurality of outgas elements are made of a thermal plastic material capable of spontaneously releasing a gas having a conductivity lower than air.

14. The commutator according to claim 1, wherein said plurality of outgas elements are made of Polyamide 66.

15. The commutator according to claim 1, wherein said cylindrical insulating base is made of a thermosetting material.

16. A method for making a commutator, comprising:

identifying an insulating base;

disposing a plurality of segments circumferentially spaced on an outer surface of the insulating base; and disposing a plurality of insulating outgas elements capable of releasing a gas having a conductivity lower than that of air and spaced on the outer surface of the insulating base between corresponding pairs of adjacent segments with gas releasing surfaces lower than outer surfaces of the segments.

17. The method of claim 16, wherein disposing a plurality of insulating outgas elements further includes disposing an outgas element of the plurality of outgas elements at least partially in a slot between a corresponding pair of adjacent segments.

18. The method of claim 16, wherein:

disposing a plurality of segments includes disposing a plurality of segments at circumferential intervals;

disposing a plurality of insulating outgas elements includes disposing an outgas element of the plurality of outgas elements at least partially in a slot between a corresponding pair of adjacent segments; and identifying an insulating base includes disposing an insulating base on the outgas elements and inner surfaces of the segments.

19. The method of claim 16, wherein:

identifying an insulating base further includes forming a plurality of grooves on the outer surface of the insulating base;

disposing a plurality of segments further includes placing two adjacent segments on opposite sides of a groove of the plurality of grooves on the outer surface of the insulating base; and disposing a plurality of insulating outgas elements further includes disposing an outgas element of the plurality of outgas elements at least partially in a corresponding groove on the outer surface of the insulating base.

20. The method of claim 16, wherein:

disposing a plurality of segments includes providing a metal ring;

identifying an insulating base includes disposing an insulating base on an inner surface of the metal ring, the insulating base having a plurality of grooves or holes on an outer periphery thereof;

disposing a plurality of insulating outgas elements includes disposing the plurality outgas elements in the plurality of grooves or holes; and disposing a plurality of segments further includes forming a plurality of through slots in the metal ring to form the segments and expose the outgas elements.

21. The method of claim 16, wherein:

disposing a plurality of segments includes providing a metal ring;

disposing a plurality of insulating outgas elements includes disposing the plurality outgas elements on an inner surface of the metal ring;

identifying an insulating base includes disposing an insulating base on the outgas elements and an inner surface of the metal ring; and disposing a plurality of segments further includes forming a plurality of through slots in the metal ring to form the segments and expose the outgas elements.

* * * * *